US009138909B2

(12) United States Patent
Naito et al.

(10) Patent No.: US 9,138,909 B2
(45) **Date of Patent: *Sep. 22, 2015**

(54) DIE AND DIE DEVICE

(71) Applicant: AMADA COMPANY, LIMITED, Kanagawa (JP)

(72) Inventors: Kinshiro Naito, Kanagawa (JP); Masayuki Shimizu, Kanagawa (JP); Shigeru Endo, Kanagawa (JP); Takashi Matsumoto, Kanagawa (JP); Hiroshi Nakai, Kanagawa (JP); Hiroyuki Kobayashi, Kanagawa (JP)

(73) Assignee: AMADA COMPANY, LIMITED, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/930,279

(22) Filed: Jun. 28, 2013

(65) Prior Publication Data

US 2013/0312580 A1 Nov. 28, 2013

Related U.S. Application Data

(60) Continuation of application No. 12/329,742, filed on Dec. 8, 2008, now Pat. No. 8,506,282, which is a division of application No. 10/517,318, filed as application No. PCT/JP03/07674 on Jun. 17, 2003, now Pat. No. 7,479,004.

(30) Foreign Application Priority Data

Jun. 18, 2002 (JP) ..... 2002-177211
May 20, 2003 (JP) ..... 2003-142267

(51) Int. Cl.
*B26D 7/18* (2006.01)
*B21D 28/34* (2006.01)

(Continued)

(52) U.S. Cl.
CPC ..... *B26D 7/1854* (2013.01); *B21D 28/34* (2013.01); *B21D 45/003* (2013.01);
(Continued)

(58) Field of Classification Search
CPC ..... B28B 13/00; B26D 7/1854; B26F 1/40; B26F 1/44; B21D 45/003; B21D 28/34; Y10T 83/0453; Y10T 83/0443; Y10T 83/2066; Y10T 83/2068; Y10T 83/9437; Y10T 83/9416
USPC ..... 425/325, 416, 542; 83/22, 24, 62.1, 98, 83/99, 100
See application file for complete search history.

(56) References Cited

U.S. PATENT DOCUMENTS 3,580,041 A 5/1971 Tilly et al.
3,710,666 A 1/1973 Keyes et al.

(Continued)

FOREIGN PATENT DOCUMENTS

JP 49-55674 5/1974

(Continued)

OTHER PUBLICATIONS

Japan Office action, mail date is Jan. 8, 2013.

*Primary Examiner* — Yogendra Gupta
*Assistant Examiner* — Emmanuel S Luk
(74) *Attorney, Agent, or Firm* — Greenblum & Bernstein, P.L.C.

(57) ABSTRACT

A die body includes a die hole for punching a work. A core, including a discharge hole, which is in communication with the die hole, is provided in the die body. The core is provided with a plurality of fluid injection ports through which fluid is injected downward of the discharge hole. The die body is provided with inflow ports through which compressed fluid flows into the fluid injection ports. The core is made of resin. The discharge hole is tapered toward its upper side. An outer peripheral surface of the die body is provided with a peripheral groove which is in communication with the inflow ports.

4 Claims, 12 Drawing Sheets

(51) Int. Cl.

| | |
|---|---|
| ***B21D 45/00*** | (2006.01) |
| ***B26F 1/40*** | (2006.01) |
| ***B26F 1/44*** | (2006.01) |

(52) U.S. Cl.

CPC ... *B26F 1/40* (2013.01); *B26F 1/44* (2013.01); *Y10T 83/0443* (2015.04); *Y10T 83/0453* (2015.04); *Y10T 83/2066* (2015.04); *Y10T 83/2068* (2015.04); *Y10T 83/9416* (2015.04); *Y10T 83/9425* (2015.04); *Y10T 83/9437* (2015.04)

(56) References Cited

U.S. PATENT DOCUMENTS

| | | | | |
|---|---|---|---|---|
| 4,425,829 | A | 1/1984 | Kranik et al. | |
| 4,821,614 | A | 4/1989 | Fleet et al. | |
| 5,111,723 | A | 5/1992 | Andrusch et al. | |
| 5,907,985 | A | 6/1999 | Bezama et al. | |
| 8,491,298 | B2 * | 7/2013 | Cade et al. | 425/500 |
| 2005/0247181 | A1 | 11/2005 | Kato | |
| 2010/0009027 | A1 * | 1/2010 | Cade et al. | 425/542 |

FOREIGN PATENT DOCUMENTS

| | | |
|---|---|---|
| JP | 49-713 | 10/1974 |
| JP | 52-99588 | 1/1977 |
| JP | 52-50475 | 4/1977 |
| JP | 57-189255 | 12/1982 |
| JP | 61-152307 | 7/1986 |
| JP | 5-057687 | 3/1993 |
| JP | 5-261454 | 10/1993 |
| JP | 6-198505 | 7/1994 |
| JP | 6-297054 | 10/1994 |
| JP | 7-155865 | 6/1995 |
| JP | 7-241634 | 9/1995 |
| JP | 8-238528 | 9/1996 |
| JP | 9-70797 | 3/1997 |
| JP | 10-044099 | 2/1998 |
| JP | 11-058297 | 3/1999 |
| JP | 2000-051966 | 2/2000 |
| JP | 2000-176714 | 6/2000 |
| JP | 3245935 | 11/2001 |
| JP | 2004-001000 | 1/2004 |
| WO | 03/103871 | 12/2003 |

* cited by examiner

DIE AND DIE DEVICE

The present application is a Continuation Application of U.S. patent application Ser. No. 12/329,742, filed on Dec. 8, 2008, which is a divisional of U.S. application Ser. No. 10/517,318, filed on Dec. 17, 2004, now U.S. Pat. No. 7,479,004, which issued on Jan. 20, 2009, the subject matter of which are expressly incorporated herein by reference in its entirety. U.S. patent application Ser. No. 10/517,318 was a National Stage of International Application PCT/JP03/07674, filed on Jun. 17, 2003, which claims the benefit of Japanese Patent Application Nos. 2002-177211, filed on Jun. 18, 2002, and 2003-142267, filed on May 20, 2003. The International Application was not published in English under the PCT Article 21(2).

TECHNICAL FIELD

The present invention relates to a die and a die apparatus used for punch press, and more particularly, to a die and die apparatus which can prevent a punching, such as a blank and a scrap punched out from a work by a punch and a die, from rising together with the punch (slug rising).

BACKGROUND ART

In a conventional punch press, when a plate-like work is punched out using a punch and a die, it is known that a punching rises together with the punch (slug rising) when the punch rises. In a state where the punching rises to an upper surface of a work, if a punching working or operation of a next work is carried out successively, the punching operation of the work may be carried out while the punching is interposed between the works in some cases, and the punch may be damaged.

In order to prevent the punching from rising, a die hole of the die is contrived variously, or the punching is drawn from below the die. For example, Japanese Utility Model Application Publication No. S52-50475 discloses a technique for drawing the punching downward.

In a first conventional technique, a die is mounted on an upper surface of a die holder, the die holder is provided with a discharge hole through while punching punched out by the die is dropped, and an air hole from which air is injected is inclined and provided in the discharge hole such that the air hole is directed downward. Air is injected downwardly from the air hole into the discharge hole, thereby sucking air from above the discharge hole.

In this structure, there are problems that it is difficult to form the air hole, a distance from the air hole to the die hole of the die is long, and the sucking effect is not sufficient.

Other than the first conventional technique, there are second and third conventional techniques disclosed in Japanese Patent Publication No. 3245935 and Japanese Patent Application Laid-Open No. Hei-5-57687.

In structures of the second and the third conventional techniques, an air injection hole is inclined from a peripheral surface of a cylindrical die to a discharge hole. If the air injection hole is expressed in a sectional view of an end surface taken along an axis of the die at an outer peripheral surface of the die, the air injection hole is worked from a portion expressed as a straight line which is in parallel to the axis of the die. Therefore, the conventional technique has a problem that it is troublesome to work the air injection hole, and the structure becomes expensive. When the air injection hole is deep, there are problems that a thin and long drill is required, and when the working of the air injection hole is started, a tip end of the drill is prone to deviate from the working position, the drill is prone to be bent and damaged.

The present invention has been achieved in order to solve the above problems, and it is an object of the present invention to provide a die and a die apparatus that can prevent a punching from rising.

DISCLOSURE OF THE INVENTION

To achieve the above object, a first aspect of the present invention provides a die, comprising: a die body having a die hole for punching a work; and a core provided in the die body and having a discharge hole which is in communication with the die hole, wherein the core is provided with a plurality of fluid injection ports for obliquely injecting fluid downward of the discharge hole, and the die body is provided with an inflow port through which compressed fluid flows into the fluid injection port.

A second aspect of the present invention provides the die according to the first aspect, wherein the core is made of resin, and the discharge hole is tapered toward its upper side.

A third aspect of the present invention provides the die according to the first or die second aspect, wherein an outer peripheral surface of the die body is formed with a peripheral groove which is in communication with the inflow port.

A fourth aspect of the present invention provides a die apparatus, comprising: a die body having a die hole for punching a work; and a die holder formed with a die mounting hole for detachably holding the die body, wherein the die body is provided with a negative pressure generator which downwardly draws a punching punched out by the die hole, the die body is provided with an inflow port through which compressed fluid flows into the negative pressure generator, and the die holder is provided with a fluid supply hole through which the compressed fluid is supplied to the inflow port.

A fifth aspect of the present invention provides the die apparatus according to the fourth aspect, wherein the die mounting hole is provided at its upper portion and lower portion with a seal section which prevents the compressed fluid from leaking.

According to the die of the first to the third aspects, and the die apparatus of the fourth and the fifth aspects, since the resin core is fitted into the recess of the die, the die can be reduced in weight.

A negative pressure generator which draws and drops the punching punched out by the die hole of the die can be formed near the die hole, and the above conventional problems can be overcome.

A sixth aspect of the present invention provides a die, comprising: a die body provided at its upper portion with a die hole; a discharge hole formed in the die body and having a diameter larger than that of the die hole; and a hole-forming tool engaging section formed on an outer peripheral surface of the die body, wherein the hole-forming tool engaging section is formed with an inclined air injection hole for injecting air downward of the discharge hole.

A seventh aspect of the present invention provides the die according to the sixth aspect, wherein the hole-forming tool engaging section is a portion of a peripheral groove formed in an outer peripheral surface of the die body.

An eighth aspect of the present invention provides the die according to the sixth or the seventh aspect, wherein the hole-forming tool engaging section is an inclined surface formed on an outer peripheral surface of the die body by countersinking working.

A ninth aspect of the present invention provides a die, comprising: a die body provided at its upper portion with a die hole; and a discharge hole formed in the die body and having a diameter larger than that of the die hole, wherein the die body is formed with a through hole which is in communication with the discharge hole and an outer piece is fitted into the through hole, and the outer piece is formed with an inclined air injection hole for injecting air downward of the discharge hole.

A tenth aspect of the present invention provides a die, comprising: a die body provided at its upper portion with a die hole; and a discharge hole formed in the die body and having a diameter larger than that of the die hole, wherein an inner peripheral surface of the die body is provided with a hole-forming tool engaging section, and the hole-forming tool engaging section is formed with an inclined air injection hole for injecting air downward of the discharge hole.

An eleventh aspect of the present invention provides the die according to the tenth aspect, wherein the hole-forming tool engaging section is a portion of an inner peripheral groove formed in an inner peripheral surface of the die body, or a countersunk portion, or a tapered surface.

A twelfth aspect of the present invention provides the die according to the tenth or the eleventh aspect, wherein the air injection hole is connected to a communication hole formed from an outer peripheral surface of the die body.

According to the die of the sixth to the twelfth aspects, the air injection hole which is inclined with respect to the die body of the die can easily be formed, and the above conventional problems can be overcome.

THE BEST MODE FOR CARRYING OUT THE INVENTION

Embodiments of the present invention will be explained in detail with reference to the accompanying drawings.

Figure 1:
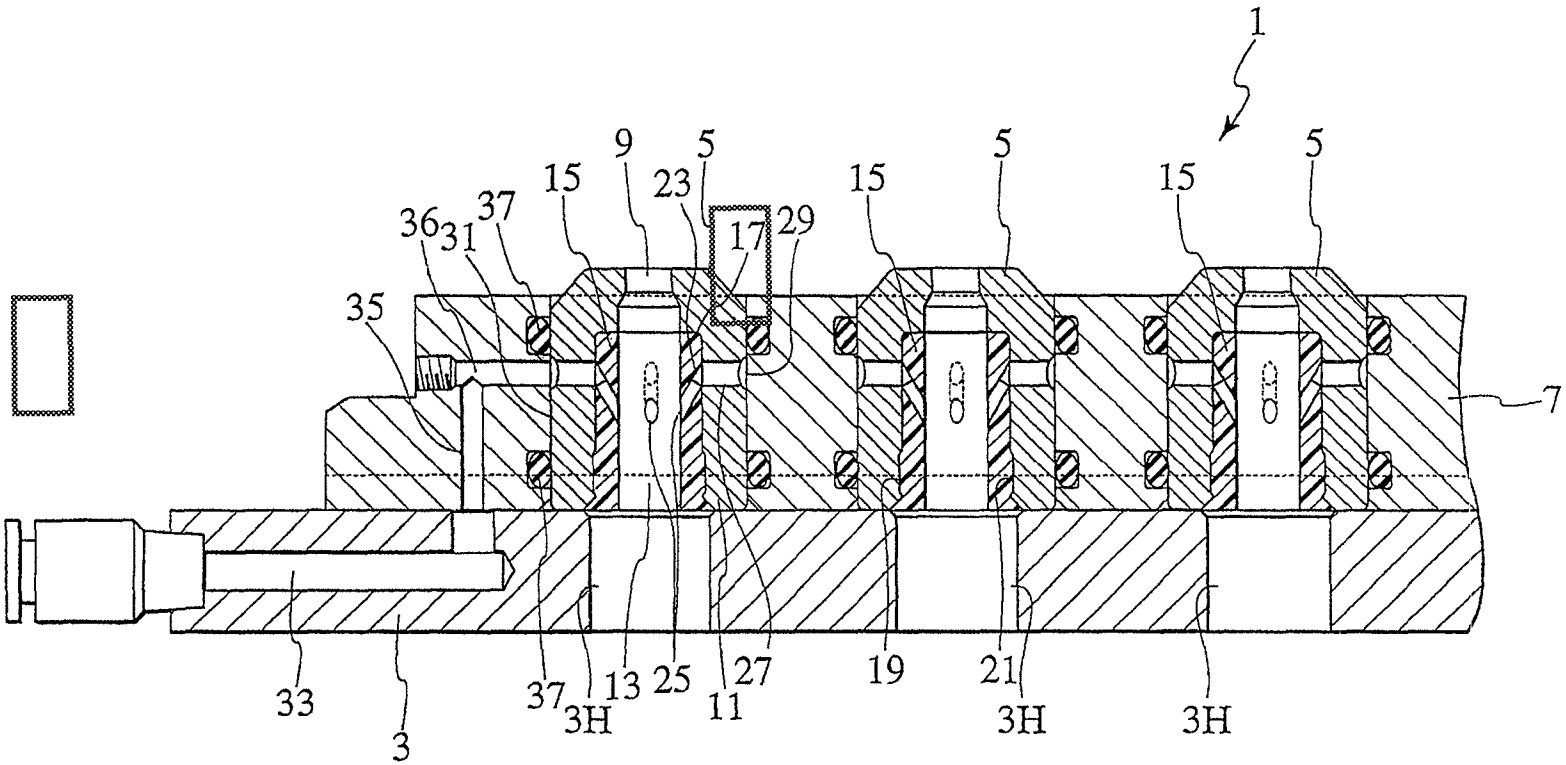
FIG. 1 is a sectional view for explaining a die and a die apparatus according to an embodiment of the present invention.

With reference to FIG. 1, a die apparatus 1 of an embodiment of the present invention includes a die base 3 mounted on an appropriate punch press (not shown) such as a turret punch press. A die holder 7 having a plurality of detachable dies 5 is detachably mounted on the die base 3.

Each of the dies 5 includes a die body 11 which is provided at its upper portion with a die hole 9 to punch out a plate-like work together with a punch (not shown). A core 15 includes, in the die body 11, a discharge hole 13 which is in communication with the die hole 9. That is, a large-diameter recess 17 which is in communication with the die hole 9 is formed in the die body 11, and the core 15 is fitted into the recess 17.

The core 15 is made of appropriate resin. A convex stripe 21 is provided on an outer peripheral surface of a lower portion of the core 15, the convex stripe 21 being engaged with a peripheral groove 19 formed in an inner peripheral surface of a lower portion of the recess 17 so that the core 15 does not easily come out from the recess 17. An outer peripheral surface of an upper portion of the core 15 is formed with a peripheral groove 23 which is in communication with a plurality of fluid injection ports 25.

The fluid injection ports 25 are provided in a circumferential direction of the discharge hole 13 at equal distances from one another, and the fluid injection ports 25 are inclined such that compressed air is injected downward of the discharge hole 13. The die body 11 is provided with a plurality of inflow ports 27 from which the compressed air flows into the fluid injection ports 25. Peripheral grooves 29 which are in communication with the inflow ports 27 are formed in an outer peripheral surface of the die body 11. The fluid injection port 25 may inject compressed air in a direction deviated from an axis of the discharge hole 13 in a radial direction such that the compressed air injected from the fluid injection port 25 causes a rotational flow in the discharge hole 13.

In the die apparatus 1, the die holder 7 includes die mounting holes 31 into which the dies 5 are detachably fitted. Each die holder 7 is provided with a fluid supply hole 35 which is in communication with a compressed air supply hole 33 formed in the die base 3. The fluid supply hole 35 is in communication with the die mounting holes 31 at positions corresponding to the peripheral grooves 29 of the dies 5 mounted in the die mounting holes 31. It is desirable that an O-ring 37 as a seal section is provided between an upper portion and a lower portion of each die mounting hole 31 to prevent the compressed air from leaking from a gap between an inner peripheral surface of the die mounting hole 31 and an outer peripheral surface of the die body 11.

In the above structure, the compressed air supply hole 33 provided in the die base 3 is connected to a pressure source (not shown) such as a compressor, and if compressed air is supplied to the fluid supply hole 35, the compressed air flows in from the inflow ports 27 of the die body 11, and the compressed air is injected from the fluid injection port 25 downward of the discharge hole 13.

Therefore, the compressed air injected from the fluid injection port 25 downward of the discharge hole 13 forms a downward air flow and with this, outside air is drawn from the die hole 9. That is, a negative pressure is generated in the underside close to the die hole 9. A plate-like work is positioned on the die 5 and if the work is punched out using the punch (not shown) and the die 5, the punching such as a blank or a scrap punched out into the die hole 9 is drawn downward, and is discharged out from the discharge hole 3H of the die base 3. Therefore, when the punch is moved upward, the punching is prevented from rising (slug rising).

As already understood, according to the present embodiment, the fluid injection port 25 which injects compressed air downward in the discharge hole 13 is provided in the die 5, the compressed air is injected from the fluid injection port 25 and the air flow is generated to create the negative pressure, and the negative pressure draws the outside air. This portion comes close to the die hole 9 of the die 5, and the drawing operation from the die hole 9 into the downward direction of the punching can effectively be carried out.

The outer peripheral surface of the die body 11 is provided with the peripheral groove 29 which is in communication with the inflow ports 27. Therefore, the compressed air can be supplied to the inflow ports 27 equally. Since the resin core 15 is provided in the recess 17 of the die body 11, the die 5 can be reduced in weight. Since the core 15 is made of resin, the inclined fluid injection port 25 and the like can be formed easily.

Since the seal section is provided on the upper portion and the lower portion of the die mounting hole 31 of the die holder 7, the compressed air can be prevented from leaking from the die mounting hole 31, and the pressure of the compressed air can be prevented from lowering.

Since the dies 5 are independently used and are not used simultaneously, it is desirable that the die mounting holes 31 and the fluid supply holes 35 are independently connected to each other through switch valves (not shown), and compressed air is independently supplied to the die mounting holes 31 in correspondence with the dies 5 to be used. However, when the capacity of the pressure source is great and there is no problem in supplying the compressed air to the plurality of die mounting holes 31 simultaneously, the compressed air may be supplied to the plurality of die mounting holes 31 at the same time.

The diameter of the inclined fluid injection port 25 may be set smaller than that of the inflow port 27 or may be set equal thereto. If the diameter of the inclined fluid injection port 25 is set smaller than that of the inflow port 27, the flow rate of the compressed air in the fluid injection port 25 is increased, the drawing operation of the compressed air from the die hole 9 into the downward direction of the punching can be carried out more effectively.

Figure 2:
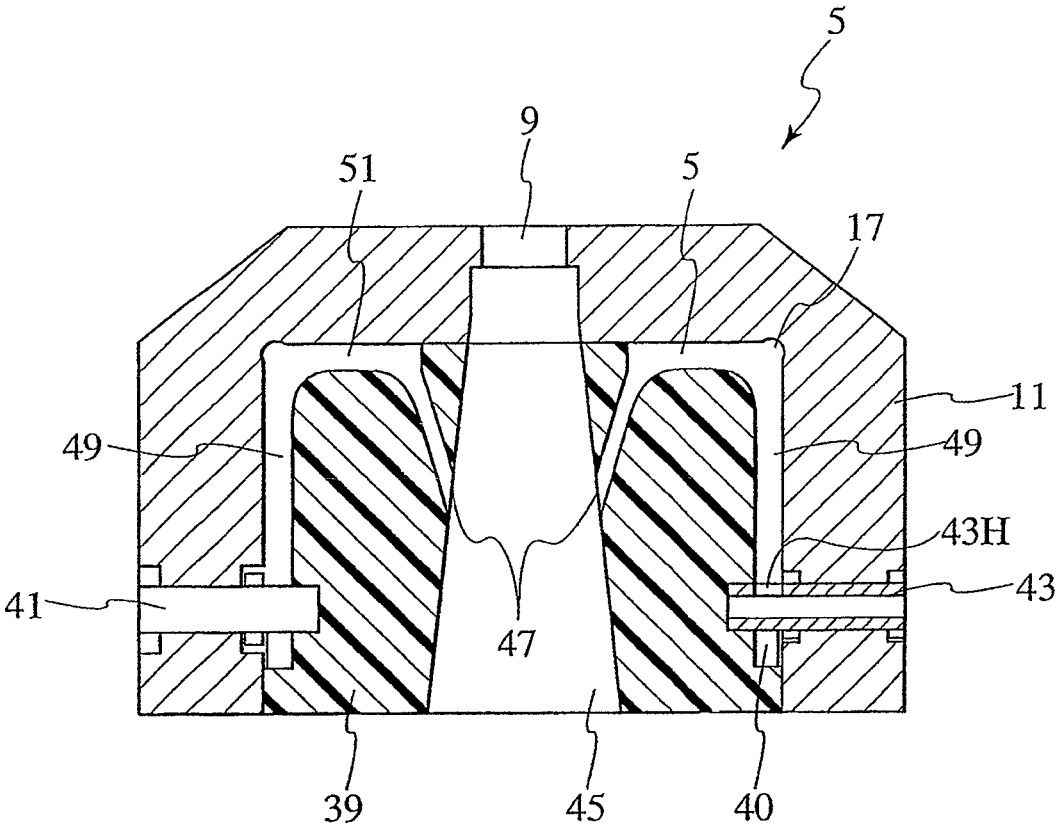
FIG. 2 is an explanatory view showing a second embodiment of the die according to the present invention.

FIG. 2 shows a second embodiment of the die 5. In the second embodiment, a resin core 39 which is tightly fitted into the recess 17 of the die body 11 is fixed by a positioning pin 41 which is detachably and threadedly fixed to the die body 11, and a supply pipe 43 which is detachably mounted on the die body 11. The core 39 is provided at its central portion with a discharge hole 45 of which upper portion is in communication with the die hole 9. The discharge hole 45 is tapered toward its upper end.

In order to inject compressed air in a downward direction in the discharge hole 45, a plurality of fluid injection ports 47, directed downward of the discharge hole 45, are provided near the upper portion of the core 39. The compressed air injected from the fluid injection port 47 may cause a rotational flow in the discharge hole 45. In order to introduce the compressed air supplied from the supply pipe 43 to the fluid injection port 47, vertical grooves 49, extending to the upper surface of the core 39, are formed in an outer peripheral surface of the core 39. The core 39 is formed at its upper surface with a plurality of communication grooves 51 horizontally. The communication grooves 51 are in communication with the grooves 49 and the fluid injection port 47.

According to the structure in which the communication grooves 51 formed in the upper surface and the fluid injection ports 47 are in communication, outlets of the inclined fluid injection ports 47 can be provided at relatively high positions, and the slug rising can be prevented more effectively.

In the above structure, if the compressed air is supplied to each groove 49 through a hole 43H of each supply pipe 43 provided at plural positions, the compressed air is injected from the plurality of fluid injection ports 47 provided in the core 39 downward of the discharge holes 45, and the punching punched out in the die hole 9 is downwardly drawn and dropped as in the previous embodiment, and the same effect as that of the previous embodiment can be exhibited.

A lower conduit 40 of the supply pipe 43 may be formed annularly and may be brought into communication with each groove 49 so that the plurality of supply pipes 43 may be formed as one pipe.

Since the discharge hole 45 has the tapered hole, air flowing through the discharge hole 45 is faster at its upper portion than at is lower portion, and the punching can be drawn and dropped from the die hole 9 more effectively.

Figure 3:
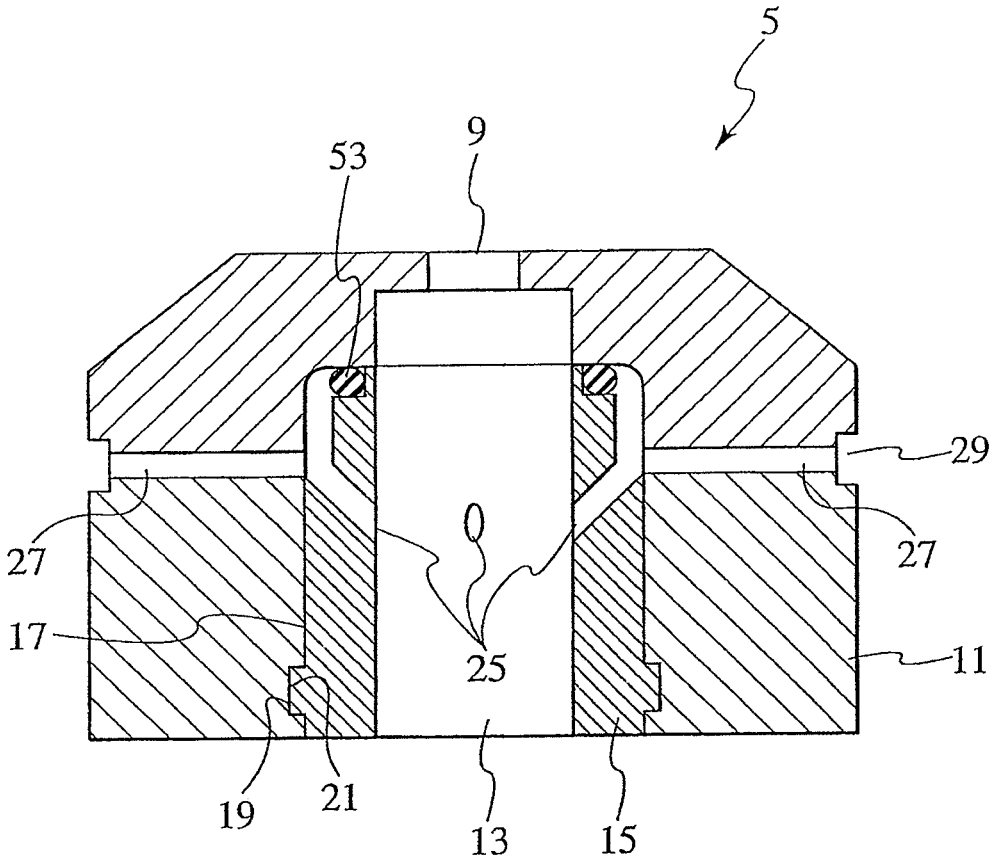
FIG. 3 is an explanatory view showing a third embodiment of the die according to the present invention.

FIG. 3 shows a third embodiment of the die 5. This die 5 has basically the same structure as that shown in FIG. 1, and members having the same function are designated with the same symbols, and redundant explanation is omitted. In the die 5, the core 15 is provided at its upper portion with a seal member 53 such as an O-ring to prevent compressed air from leaking from a gap between the upper surface of the core 15 and an upper surface of the recess 17 into which the core 15 is inserted.

Therefore, air is not leaked downward of the die hole 9, and the negative pressure portion can effectively be generated at a lower side of the die hole 9.

A die according to a fourth embodiment of the present invention will next be explained with reference to the drawings.

Figure 4A:
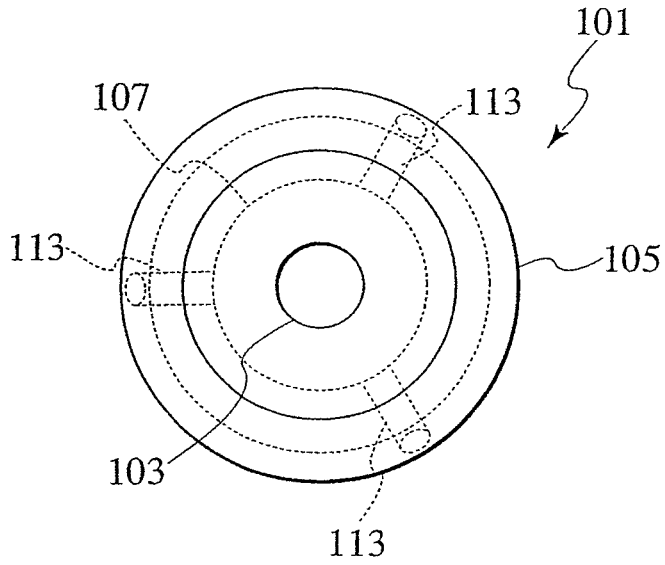
FIGS. 4A and 4B are explanatory views showing a fourth embodiment of the die according to the present invention.
Figure 4B:
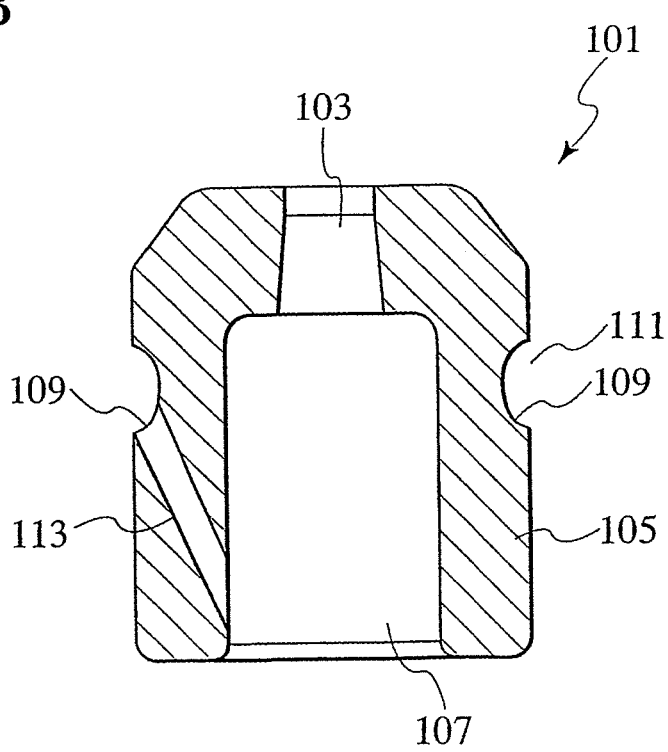

With reference to FIG. 4, a die 101 according to the fourth embodiment of the present invention has a cylindrical die body 105 provided at its upper portion with a die hole 103, and a discharge hole 107 having a larger diameter than that of the die hole 103. The discharge hole 107 is provided in the die body 105. A hole-forming tool engaging section is formed on an upper portion of an outer peripheral surface of the die body 105. The hole-forming tool engaging section engages with a hole-forming tool which forms the air injection hole 113 when the air injection hole 113 is to be formed such that a tip end of the hole-forming tool does not slip. As one example of the hole-forming tool engaging section, the die body 105 is formed at its outer peripheral surface with an inclined surface 109 of which side close to an axis of the die body 105 becomes high. In FIG. 4, the inclined surface 109 is a peripheral groove 111 having an arc (C-shaped) cross section for example. The peripheral groove 111 may have a V-shaped cross section. The peripheral groove 111 may be formed in an outer peripheral surface of the die body 105 partially or over its entire circumference.

The inclined surface 109 is provided with inlets of the plurality of air injection holes 113 in the circumferential direction at equal distances from one another. Air is injected through the air injection holes 113 downward of the discharge hole 107. It is desirable that the axis of the air injection hole 113 intersects with the inclined surface 109 at right angles. To be precise, since the inclined surface 109 is illustrated to have the arc cross section in the embodiment, it is desirable that the axis of the air injection hole 113 intersects, at right angles, with a tangent at an intersection point between the axis of the air injection hole 113 and a curved surface of the inclined surface 109 having an arc cross sectional shape. However, it is not always necessary that the tangent and the axis intersect with each other at right angles, and they may be inclined to some extent within a permissible range.

As can be understood from the above, since the air injection hole 113 is formed at a portion of the inclined surface 109 as the hole-forming tool engaging section, a component of force generated in a tip end of the hole-forming tool engaging section when the air injection hole 113 is formed while applying thrust to the drill is small. Therefore, even when a thin and long drill is used as the hole-forming tool for making the hole, the tip end of the drill does not slip with respect to the inclined surface 109 and the tip end engaged with the inclined surface 109. Thus, it is possible to prevent the drill tip end from deviating from the drilling position by the component of force which is applied to the drill tip end at the time of the drilling operation. Therefore, the air injection hole 113 can easily be formed without damaging the hole-forming tool such as a drill.

The peripheral groove may be of U-shape in cross section. In this case, the groove may not be provided over the entire circumference in the outer peripheral surface of the die body 105, and it is sufficient to provide the grooves only in the necessary portions in the die body 105, but the groove may be formed over the entire circumference. Such a groove can be formed by cutting a part of the outer peripheral surface of the die body 105 using a milling cutter or the like.

With the structure in which the groove having the U-shaped cross section is formed in the outer peripheral surface of the die body 105 as described above, the tip end of the hole-forming tool such as a drill is positioned or placed on the angle portion which intersects with a plane to form the hole. With this, the tip end of the drill does not slip by the component of force applied to the tip end of the drill and the tip end is engaged. Therefore, the inclined air injection hole 113 can easily be formed in the die body 105.

When the air injection hole 113 is to be formed, the hole-forming tool is not limited to a cutting tool such as the drill, and the air injection hole 113 can also be formed using electrical discharge machining using a thin pipe material as an electrode. In this case, the electrode functions as the hole-forming tool.

Figure 5A:
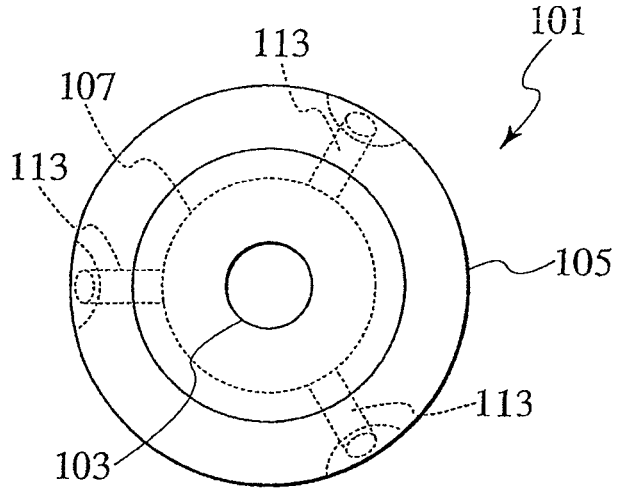
FIGS. 5A and 5B are explanatory views showing a fifth embodiment of the die according to the present invention.
Figure 5B:
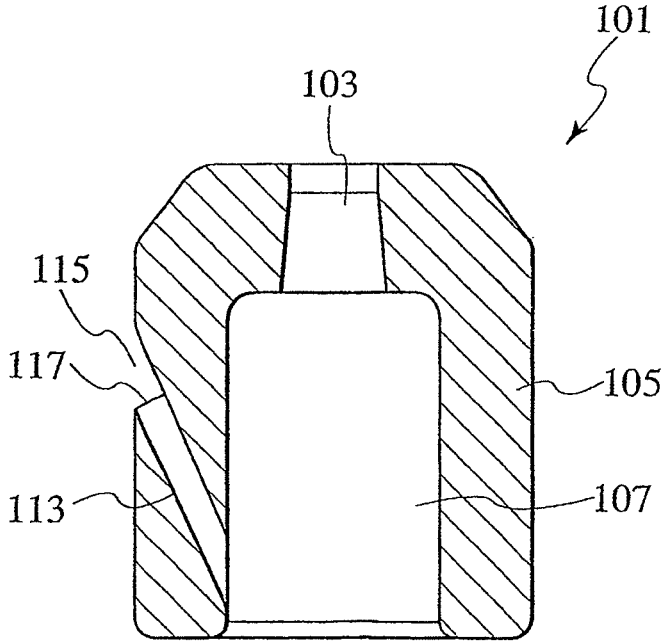

FIG. 5 snow a fifth embodiment of the present invention. Constituent elements having the same function as those of the previous structure are designated with the same symbols, and redundant explanation is omitted. In the fifth embodiment, a plurality of portions of the outer peripheral surface of the die body 105 are subjected to countersinking working using a rotating cutting tool such as an end mill, thereby forming the hole-forming tool engaging section. That is, an inclined surface 117 corresponding to the inclined surface 109 is formed at a bottom of a countersunk portion 115.

In this structure, when the countersunk portion 115 is to be formed in the outer peripheral surface of the die body 105 in a state where an axis of a milling cutter such as the end mill is appropriately inclined with respect to an axis of the die body 105, the inclined surface 117 is formed flat. Therefore, the air injection hole 113 can be formed such that the hole intersects with the inclined surface 117 at right angles, and even if the drill is thin and long, its tip end does not slip by the component of force, and the hole can be formed easily without damaging the drill; That is, the hole can be formed in a state where the drill as a hole-forming tool is engaged without slipping at its tip end.

Figure 6A:
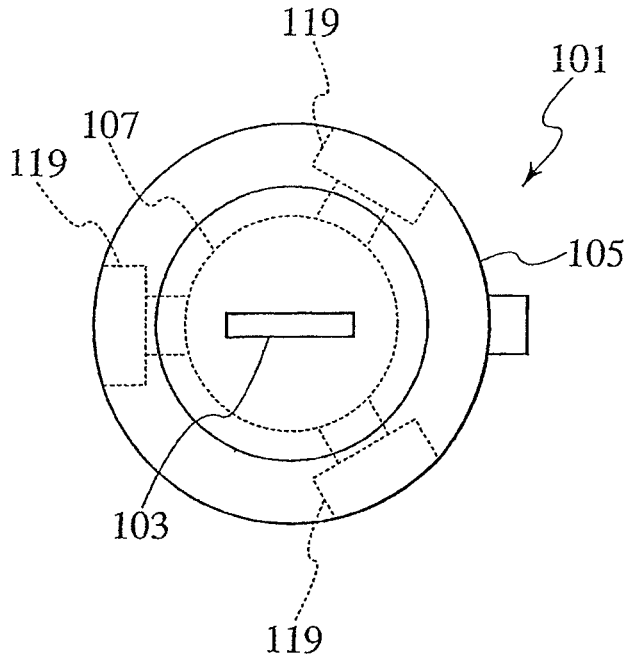
FIGS. 6A and 6B are explanatory views showing a sixth embodiment of the die according to the present invention.
Figure 6B:
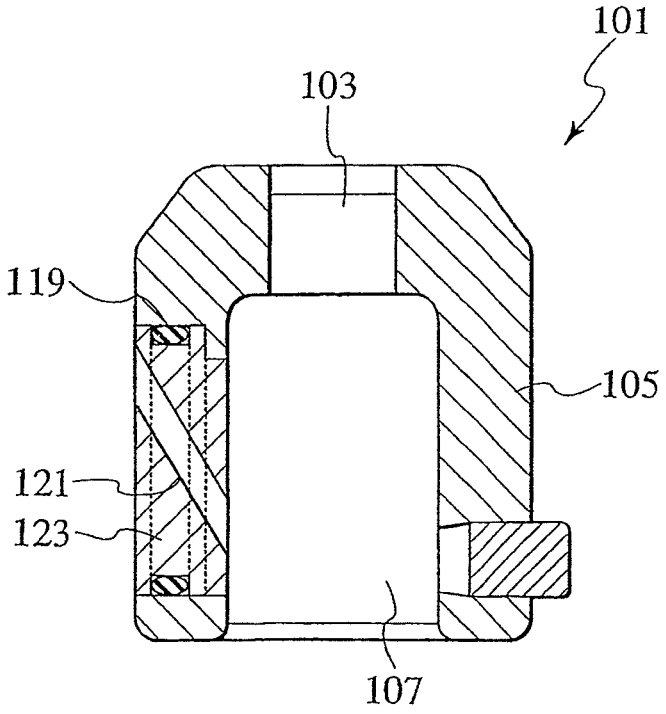
Figure 7A:
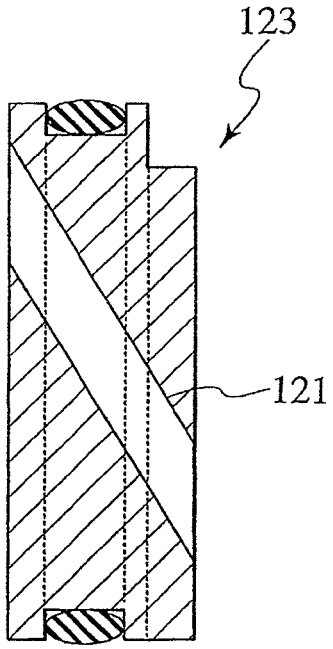
FIGS. 7A and 7B are explanatory views of an outer piece according to the present invention.
Figure 7B:
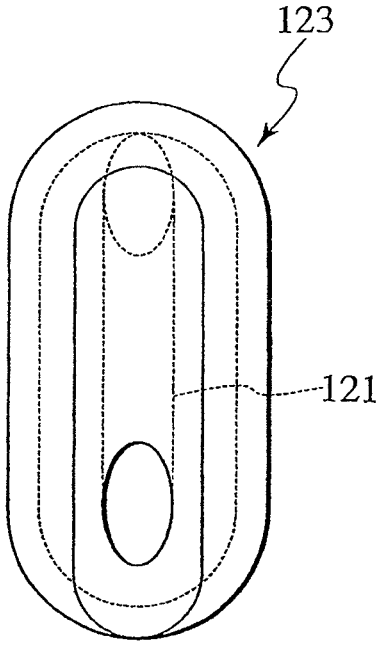

FIG. 6 show a sixth embodiment of the present invention. Constituent elements having the same function as those of the previous structure are designated with the same symbols, and redundant explanation is omitted. In the sixth embodiment, a plurality of portions of the die body 105 of the die 101 are formed with vertically long through holes 119. As shown in FIG. 7, a rubber or resin outer piece 123 is fitted into each of the through holes 119. The outer piece 123 has a previously inclined air injection hole 121.

According to this structure, the resin outer piece 123 having the air injection hole 121 is fitted into and fixed to the through hole 119 formed in the die body 105. Therefore, the die 101 having the air injection hole 121 can easily be created.

When the outer piece 123 is made of resin which can relatively easily be worked, it is also possible to form the air injection hole 121 after the outer piece 123 is fitted into and fixed to the through hole 119 of the die body 105.

Figure 8A:
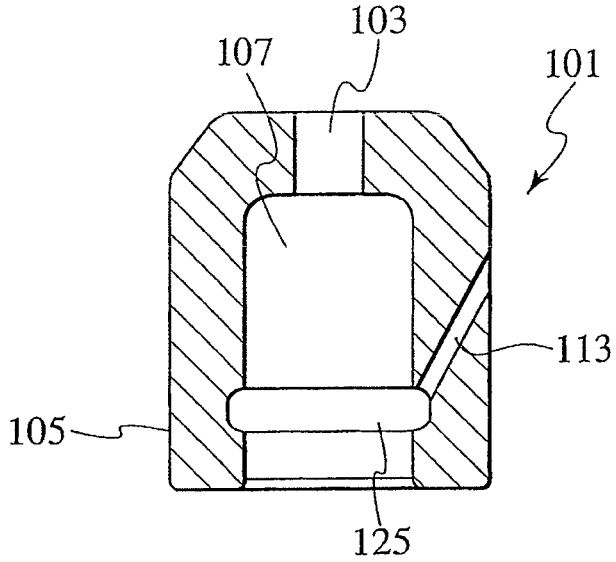
FIGS. 8A, 8B, and 8C are explanatory views showing a seventh embodiment of the die according to the present invention.
Figure 8B:
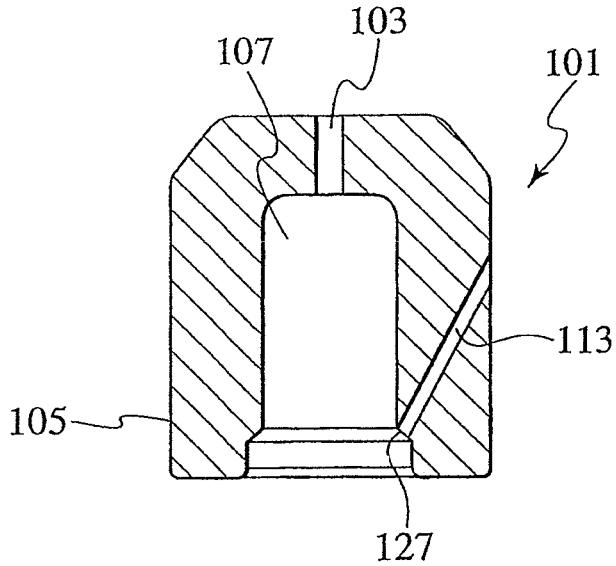
Figure 8C:
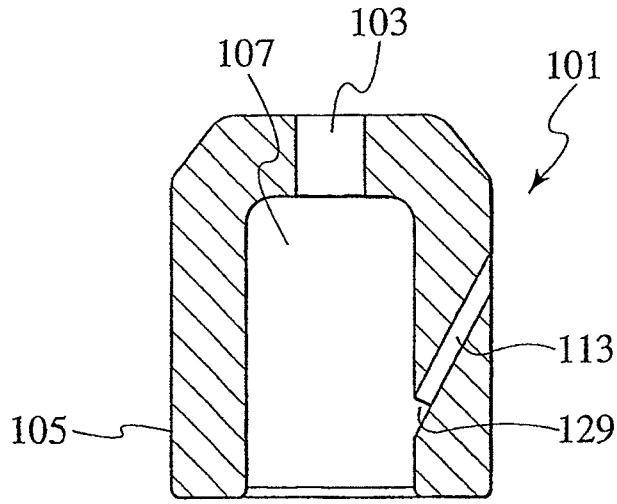

FIG. 8 show a seventh embodiment of the present invention. Constituent elements having the same function as those of the previous structure are designated with the same symbols, and redundant explanation is omitted. In the fourth embodiment, the hole-forming tool engaging section is provided on the inner peripheral surface of the discharge hole 107 of the die body 105. FIG. 8A exemplifies a structure in which an inner peripheral groove 125 corresponding to the peripheral groove 111 is formed as the hole-forming tool engaging section, and the peripheral groove 125 is formed with the air injection hole 113. FIG. 8B shows a structure in which a tapered surface 127 is formed with the air injection hole 113 as the hole-forming tool engaging section. FIG. 8C exemplifies a structure in which the inner peripheral surface of the die body 105 is formed with a countersunk portion 129 which is the same as the countersunk portion 115, the countersunk portion 129 functions as the hole-forming tool engaging section, and the countersunk portion 129 is formed with the air injection hole 113.

According to the above structures also, a component of force which damages the hole-forming tool is not applied when the air injection hole 113 is formed, and the air injection hole 113 can easily be formed.

FIG. 9 show an eighth embodiment of the present invention. Constituent elements having the same function as those of the previous structure are designated with the same symbols, and redundant explanation is omitted. In the eighth embodiment, the die body 105 has a die chip 131 including the die hole 103. The air injection hole 113 is formed at a position where the air injection hole 113 does not interfere with the die chip 131.

Figure 9A:
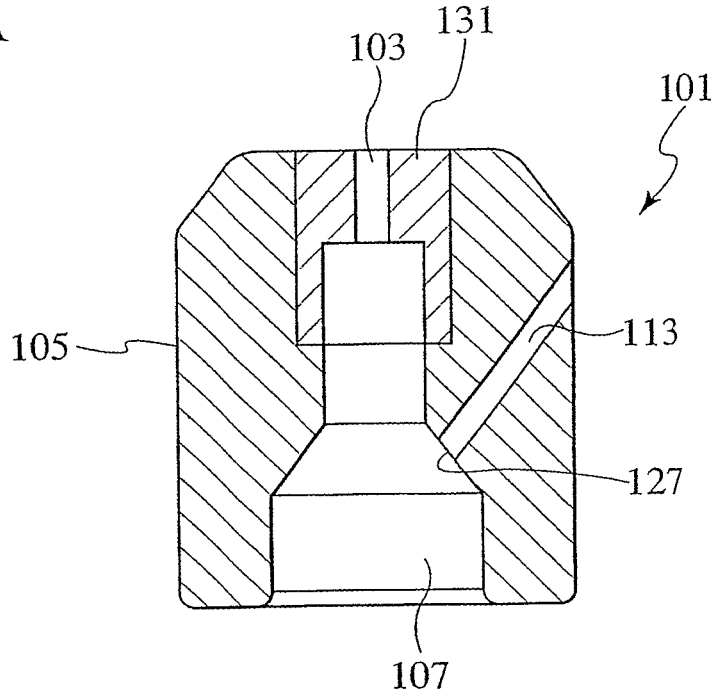
FIGS. 9A and 9B are explanatory views showing an eighth embodiment of the die according to the present invention.
Figure 9B:
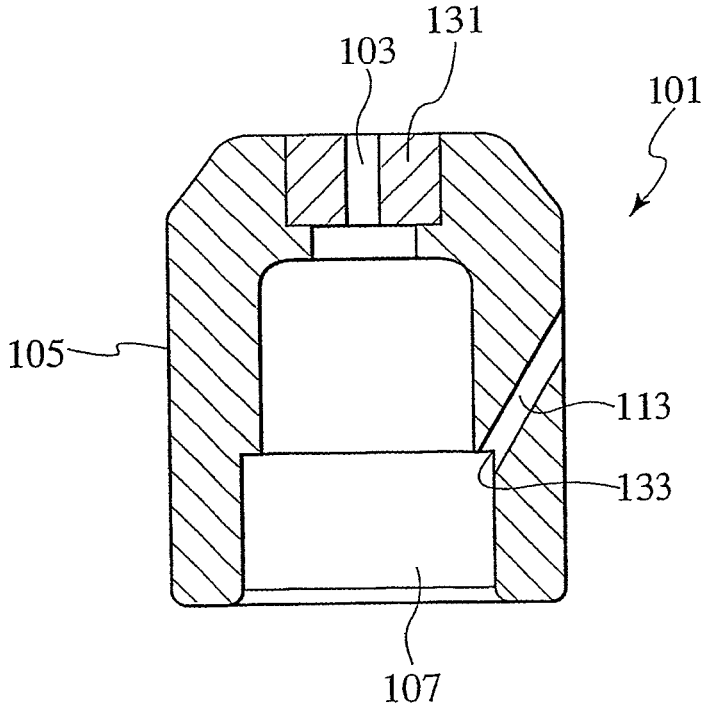

FIG. 9A exemplifies a structure in which the tapered surface 127 is formed with the air injection hole 113 as the hole-forming tool engaging section. FIG. 9B exemplifies a structure in which the air injection hole 113 is formed in a step (angle portion) 133 of the peripheral groove as the hole-forming tool engaging section.

According to these structures also, the hole-forming tool is not damaged by a component of force when the air injection hole 113 is formed, and the air injection hole 113 can easily be formed. Although this structure has the die chip 131, the air injection hole 113 can be formed without any problem.

Figure 10:
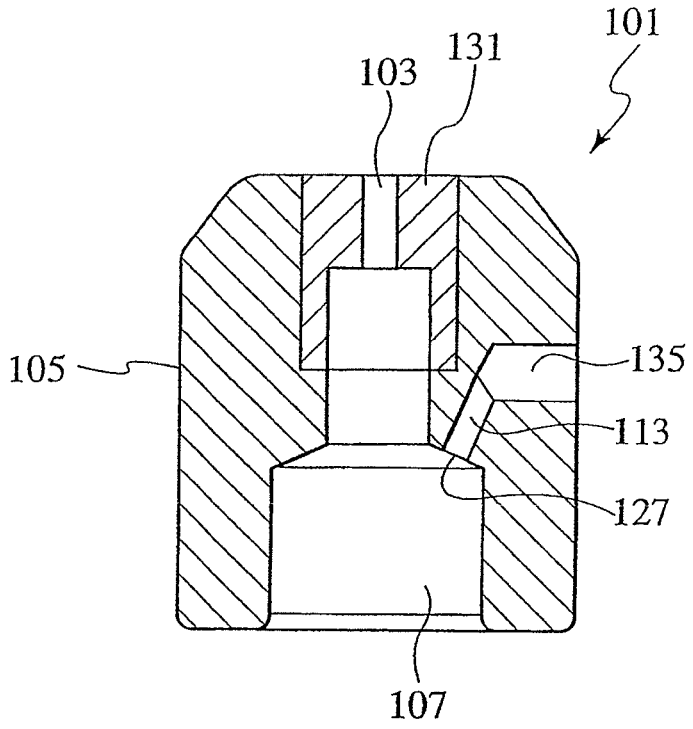
FIG. 10 is an explanatory view showing a ninth embodiment of the die according to the present invention.

FIG. 10 shows a ninth embodiment of the present invention which is a partial modification of the embodiment shown in FIG. 9A. In this ninth embodiment, a communication hole 135 is formed in an outer peripheral surface of the die body 105, and the air injection hole 113 is connected with the communication hole 135.

According to this structure, a diameter of the communication hole 135 can be formed larger than that of the air injection hole 113, the length of the air injection hole 113 can be made relatively short, and the inclining angle of the air injection hole 113 with respect to the axis of the die body 105 can be reduced. Therefore, a punched out slug in the die hole 103 can more effectively be drawn downwardly by air injected from the air injection hole 113.

Figure 11:
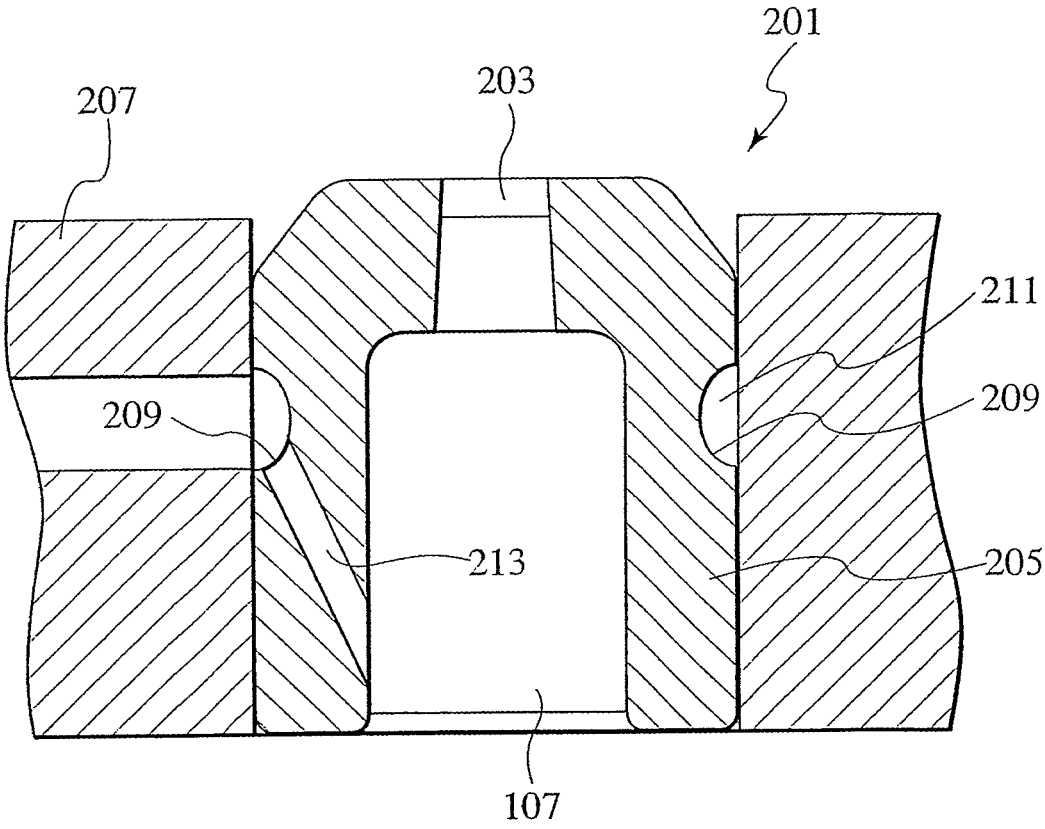
FIG. 11 is an explanatory view showing a tenth embodiment of the die according to the present invention.

FIG. 11 shows a tenth embodiment of the present invention. A die 201 has a peripheral groove 211 and a plurality of air injection ports 213. A die holder 207 is formed with a fluid supply passage. Air flows into the air injection ports 213 through the peripheral groove 211. A diameter of each of the air injection ports 213 is set smaller than that of the fluid supply passage formed in the die holder 207. Therefore, the flow rate of air flowing from the fluid supply passage formed in the die holder 207 into the air injection ports 213 is increased, and the air is injected from the air injection ports 213. With this, the downward drawing operation of the punching from the die hole 203 can be carried out more effectively.

It is desirable that a cross-sectional area of the air injection port 213 is set smaller than that of the peripheral groove 211. That is, if the cross-sectional area of the air injection port 213 is set smaller than that of the peripheral groove 211, the downward drawing operation of the punching from the die hole 203 can be carried out more effectively.

Figure 12:
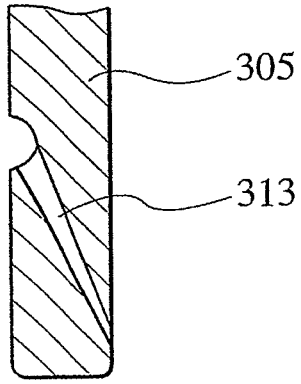
FIG. 12 is an explanatory view showing a partial modification of the tenth embodiment of the die according to the present invention.

FIG. 12 shows a partial modification of the tenth embodiment according to the present invention. An air injection port 313 of a die body 305 is tapered toward its tip end into a nozzle shape. With this structure, the flow rate of air is increased at the tip end of the air injection port 313.

Figure 13:
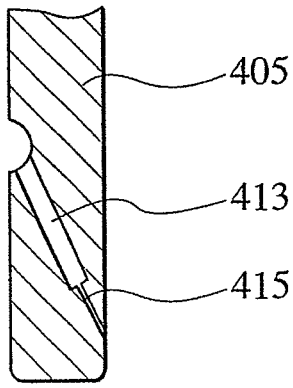
FIG. 13 is an explanatory view showing another partial modification of the tenth embodiment of the die according to the present invention.

FIG. 13 shows a partial modification of the tenth embodiment according to the present invention. Diameters of an air injection port 413 of a die body 405 are different at a tip end side and a peripheral groove side. In this embodiment, although the air injection port 313 can mechanically be formed easier as compared with the above air injection port 313, the same effect can be exhibited. That is, the air injection port has two ports, i.e., an air injection port 413 having a relatively large diameter and an air injection port 415 having a relatively small diameter. Thus, by cutting and forming the hole having the different diameters by using two kinds of drills, the air injection ports 413 and 415 can be formed.

Figure 14:
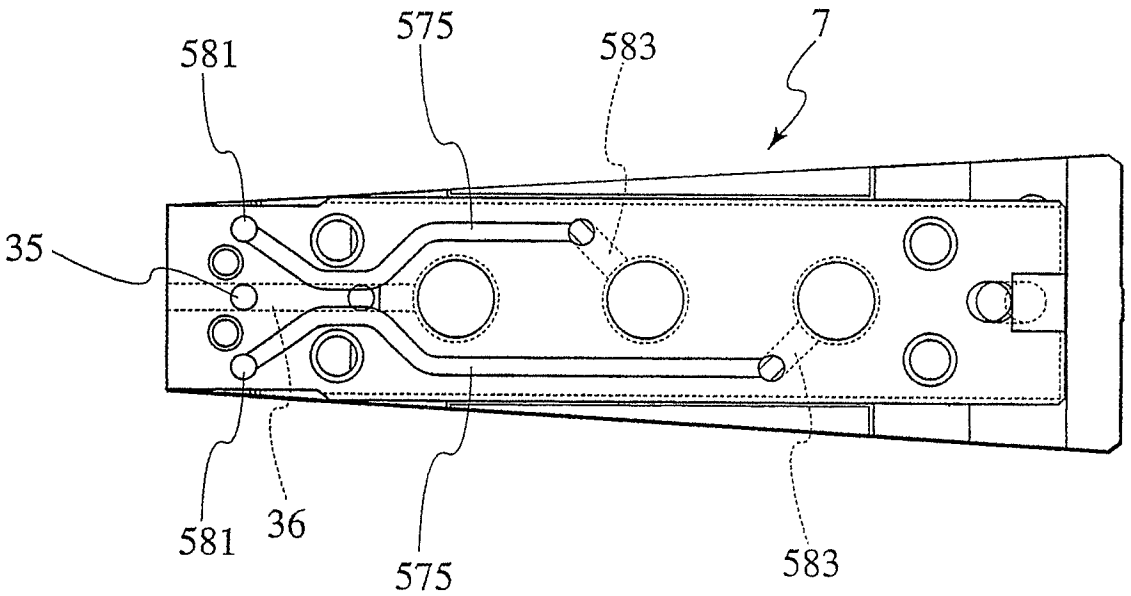
FIG. 14 is a bottom view of a die holder of an eleventh embodiment of a die apparatus according to the present invention.

FIG. 14 shows the die holder 7 of a die apparatus of an eleventh embodiment according to the present invention as viewed from its bottom. This embodiment is a partial modification of the fluid supply passage 36 of the die holder 7 shown in FIG. 1. Two fluid supply holes 581 and 581 are formed at opposite ends of the fluid supply hole 35. The fluid supply holes 581 and 581 are formed with grooves 575 and 575 which extend to positions of the dies and bend from these positions. These grooves 575 and 575 are tightly connected with an upper surface of the die base 3, thereby forming a conduit. Air flows to fluid supply passages 583 and 583 formed in the die holder 7, and the air flows into the peripheral groove formed in the die.

The disclosures of Japanese Patent Application Nos. 2002-177211 (filed on Jun. 18, 2002), and 2003-142267 (filed on May 20, 2003) are incorporated by reference herein in their entirety.

The embodiments of the present invention disclosed above are to be considered not restrictive, changes can be appropriately made, and the invention may be embodied in other specific forms.

What is claimed is:

1. A die, for preventing, by a negative pressure, the rising of a slug during a punching operation, the die comprising:

a die body having an outermost side portion and provided at its upper portion with a die hole;

a discharge hole formed in the die body and having a diameter larger than that of the die hole;

a peripheral groove formed at an outer peripheral surface of the die body and at an upper portion higher than the middle height portion of the die body, so that an inclined surface is formed at the peripheral groove; and an inclined air injection hole formed in the die body, the air injection hole having an upper end and a lower end, the upper end being opened into the inclined surface so as to break through the inclined surface, the lower end being opened into a lower portion of the discharge hole, so that the air injection hole is configured to inject air from the upper end into the discharge hole downwardly through the lower end of the air injection hole such that a negative pressure is generated proximate the die hole and above the lower end of the air injection hole, wherein the lower end of the air injection hole is located at a lower portion lower than the middle height portion of the discharge hole so that an axis of the air injection hole formed in the die body intersects an axis of the discharge hole formed in the die body outside the discharge hole.

2. The die according to claim 1, wherein the air injection hole has generally uniform diameter.

3. The die according to claim 1, wherein the axis of the air injection hole intersects the axis of the discharge hole below a bottom end of the discharge hole.

4. The die according to claim 1, wherein the die body is unitarily formed.

* * * * *